US010542776B2

(12) United States Patent
Lavanchy et al.

(10) Patent No.: US 10,542,776 B2
(45) Date of Patent: Jan. 28, 2020

(54) SMOKING ARTICLE COMPRISING AN INSULATED COMBUSTIBLE HEAT SOURCE

(71) Applicant: Philip Morris Products S.A., Neuchatel (CH)

(72) Inventors: Frederic Lavanchy, Grandson (CH); Ana Carolina Borges de Couraca, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/109,032

(22) PCT Filed: Dec. 29, 2014

(86) PCT No.: PCT/EP2014/079364
§ 371 (c)(1),
(2) Date: Jun. 29, 2016

(87) PCT Pub. No.: WO2015/101595
PCT Pub. Date: Jul. 9, 2015

(65) Prior Publication Data

US 2016/0316816 A1 Nov. 3, 2016

(30) Foreign Application Priority Data

Dec. 30, 2013 (EP) ..... 13199811

(51) Int. Cl.
*A24F 47/00* (2006.01)
*A24B 15/16* (2006.01)
*A24D 1/02* (2006.01)

(52) U.S. Cl.
CPC ..... *A24F 47/006* (2013.01); *A24B 15/165* (2013.01); *A24D 1/02* (2013.01)

(58) Field of Classification Search
None
See application file for complete search history.

(56) References Cited

U.S. PATENT DOCUMENTS 4,553,556 A * 11/1985 Lephardt ..... A24D 1/02 131/331
4,714,082 A 12/1987 Banerjee et al.
(Continued)

FOREIGN PATENT DOCUMENTS

CN 1039710 A 4/1990
CN 1043250 A 6/1990
(Continued)

OTHER PUBLICATIONS

Machine translation of JP 05-103836 (Year: 1993).*
(Continued)

*Primary Examiner* — Cynthia Szewczyk
(74) *Attorney, Agent, or Firm* — Oblon, McClelland, Maier & Neustadt, L.L.P.

(57) ABSTRACT

A smoking article is provided, including a combustible heat source having a front portion and a rear portion; an aerosol-forming substrate downstream of the rear portion of the combustible heat source; and a wrapper circumscribing the front portion and the rear portion of the combustible heat source. The wrapper is in contact with the rear portion of the combustible heat source. All or part of the front portion of the combustible heat source is of reduced diameter compared to the rear portion of the combustible heat source so that the wrapper is radially spaced from all or part of the front portion of the combustible heat source by an air gap of at least about 0.5 mm.

16 Claims, 1 Drawing Sheet

(56) References Cited

U.S. PATENT DOCUMENTS

| | | | | |
|---|---|---|---|---|
| 4,793,365 | A * | 12/1988 | Sensabaugh, Jr. ... | A24B 15/165 128/202.21 |
| 4,966,171 | A | 10/1990 | Serrano et al. | |
| 4,969,746 | A | 11/1990 | Bale et al. | |
| 5,027,837 | A * | 7/1991 | Clearman ..... | A24F 47/004 131/194 |
| 5,040,551 | A | 8/1991 | Schlatter et al. | |
| 5,067,499 | A * | 11/1991 | Banerjee ..... | A24D 1/18 131/194 |
| 2009/0065011 | A1* | 3/2009 | Maeder ..... | A24F 47/006 131/194 |
| 2012/0042885 | A1 | 2/2012 | Stone et al. | |

FOREIGN PATENT DOCUMENTS

| | | | |
|---|---|---|---|
| CN | 1024996 | C | 6/1994 |
| CN | 102946747 | A | 2/2013 |
| EA | 007828 | B1 | 2/2007 |
| EP | 0 174 645 | A2 | 3/1986 |
| EP | 0 264 195 | A1 | 4/1988 |
| EP | 0 444 553 | A2 | 9/1991 |
| JP | 61-92558 | | 5/1986 |
| JP | 2-84165 | | 3/1990 |
| JP | 5-103836 | | 4/1993 |
| JP | 2013-524650 | | 6/2013 |
| KZ | 27534 | B | 10/2013 |
| WO | WO 2009/022232 | A2 | 2/2009 |
| WO | WO 2009/074870 | A2 | 6/2009 |
| WO | WO 2012/164077 | A1 | 6/2012 |
| WO | WO 2013/120849 | A1 | 8/2013 |

OTHER PUBLICATIONS

Office Action dated Sep. 27, 2017 in Kazakhstan Patent Application No. 2016/0657.1 (with English language translation).

International Search Report and Written Opinion dated Mar. 30, 2015, in PCT/EP2014/079364 filed Dec. 29, 2014.

Combined Chinese Office Action and Search Report dated Jun. 1, 2018 in corresponding Patent Application No. 201480067891.0 (with English Translation), citing documents AO, AP and AQ therein, 15 pages.

Japanese Office Action with English translation dated Dec. 6, 2018 in corresponding Japanese Patent Application No. 2016-535216 (6 pages).

Chinese Office Action with English translation dated Feb. 19, 2019 in corresponding Chinese Patent Application No. 201480067891.0, (20 pages).

Israeli Office Action dated May 5, 2019 in Israeli Patent Application No. 244711 (with English translation), 10 pages.

* cited by examiner

SMOKING ARTICLE COMPRISING AN INSULATED COMBUSTIBLE HEAT SOURCE

The present invention relates to a smoking article comprising a combustible heat source having a front portion and a rear portion and an aerosol-forming substrate downstream of the rear portion of the combustible heat source.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user.

It is known to include a heat-conducting element around and in direct contact with at least a rear portion of the combustible heat source and at least a front portion of the aerosol-forming substrate of the heated smoking article in order to ensure sufficient conductive heat transfer from the combustible heat source to the aerosol-forming substrate to obtain an acceptable aerosol. For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate.

The combustion temperature of a combustible heat source for use in a heated smoking article should not be so high as to result in combustion or thermal degradation of the aerosol forming material during use of the heated smoking article. However, the combustion temperature of the combustible heat source should be sufficiently high to generate enough heat to release sufficient volatile compounds from the aerosol forming material to produce an acceptable aerosol, especially during early puffs.

A variety of combustible carbon-containing heat sources for use in heated smoking articles have been proposed in the art. The combustion temperature of combustible carbon-containing heat sources for use in heated smoking articles is typically between about 600° C. and 800° C.

It is known to wrap an insulating member around the periphery of a combustible carbon-containing heat source of a heated smoking article in order to reduce the surface temperature of the heated smoking article.

For example, U.S. Pat. No. 4,714,082 discloses a smoking article comprising a combustible carbon-containing fuel element, an aerosol generating means, a heat-conducting member and a peripheral insulating member of resilient, non-burning material, such as a jacket of glass fibers. The insulating member circumscribes at least part of the fuel element and advantageously at least part of the aerosol generating means.

EP-A2-0 174 645 discloses smoking articles comprising a carbonaceous fuel element, a physically separate aerosol generating means including a substrate bearing an aerosol forming material, a heat conducting member which contacts a portion of the fuel element and the substrate, and a mouthend piece. At least a part of the fuel element is preferably provided with a peripheral insulating member, such as a jacket of insulating fibers, which reduces radial heat loss and assists in retaining and directing heat from the fuel element toward the aerosol-generating means.

Inclusion of a separate insulating member as disclosed in U.S. Pat. No. 4,714,082 and EP-A2-0 174 645 may result in a heated smoking article having a transverse cross-section that is not constant along the length of the smoking article. This may adversely affect the appearance of the heated smoking article and may make it more difficult to secure reliably the combustible carbon-containing heat source within the heated smoking article. Inclusion of a separate insulating member as disclosed in U.S. Pat. No. 4,714,082 and EP-A2-0 174 645 may also add to the complexity of assembly of the heated smoking article.

It would be desirable to provide a smoking article having a reduced surface temperature proximate to the heat source, acceptable appearance, and that may be assembled in a more reliable manner.

According to the invention there is provided a combustible heat source having a front portion and a rear portion; an aerosol-forming substrate downstream of the rear portion of the combustible heat source; and a wrapper circumscribing the front portion and the rear portion of the combustible heat source, wherein the wrapper is in contact with the rear portion of the combustible heat source and wherein all or part of the front portion of the combustible heat source is of reduced diameter compared to the rear portion of the combustible heat source so that the wrapper is radially spaced from all or part of the front portion of the combustible heat source by an air gap of at least about 0.5 mm.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including the wrapper is considered to be the aerosol-forming substrate.

As used herein, the terms 'distal', 'upstream' and 'front', and 'proximal', 'downstream' and 'rear', are used to describe the relative positions of components, or portions of components, of the smoking article in relation to the direction in which a user draws on the smoking article during use thereof. Smoking articles according to the invention comprise a proximal end through which, in use, an aerosol exits the smoking article for delivery to a user. The proximal end of the smoking article may also be referred to as the mouth end. In use, a user draws on the proximal end of the smoking article in order to inhale an aerosol generated by the smoking article.

The combustible heat source is located at or proximate to the distal end. The mouth end is downstream of the distal end. The proximal end may also be referred to as the downstream end of the smoking article and the distal end may also be referred to as upstream end of the smoking article. Components, or portions of components, of smoking articles according to the invention may be described as being upstream or downstream of one another based on their relative positions between the proximal end and the distal end of the smoking article.

The front portion of the combustible heat source is at the upstream end of the combustible heat source. The upstream end of the combustible heat source is the end of the combustible heat source furthest from the proximal end of the smoking article. The rear portion of the combustible heat source is at the downstream end of the combustible heat source. The downstream end of the combustible heat source is the end of the combustible heat source closest to the proximal end of the smoking article.

As used herein, the term 'longitudinal' is used to describe the direction between the proximal end and the opposed distal end of the smoking article.

As used herein, the terms 'radial' and 'transverse' are used to describe the direction perpendicular to the direction between the proximal end and the opposed distal end of the smoking article.

As used herein, the term 'length' is used to describe the maximum dimension in the longitudinal direction of the smoking article. That is, the maximum dimension in the direction between the proximal end and the opposed distal end of the smoking article.

Smoking articles according to the invention include an air gap of at least 0.5 mm between at least part of the front portion of the combustible heat source and the wrapper. Inclusion of an air gap of at least about 0.5 mm between all or part of the front portion of the combustible heat source and the wrapper advantageously insulates the combustible heat source, and so reduces the surface temperature of the smoking article proximate to the combustible heat source.

All or part of the front portion of the combustible heat source of smoking articles according to the invention is of reduced diameter compared to the rear portion of the combustible heat source. The reduced diameter of all or part of the front portion of the combustible heat source compared to the rear portion of the combustible heat source allows the wrapper to be in contact with the rear portion of the combustible heat source despite the inclusion of an air gap between all or part of the front portion of the combustible heat source and the wrapper. This advantageously helps to retain the combustible heat source within the smoking article. It also helps to facilitate adequate heat transfer from the combustible heat source to the aerosol-forming substrate to provide an acceptable aerosol.

As used herein, the expression 'in contact' is used to mean that there is no air gap between the wrapper and the rear portion of the combustible heat source.

The wrapper may be radially spaced from all or part of the front portion of the combustible heat source by an air gap of at least about 1.0 mm.

Preferably, the wrapper is radially spaced from all or part of the front portion of the combustible heat source by an air gap of between about 0.5 mm and about 1.5 mm. The wrapper may be radially spaced from all or part of the front portion of the combustible heat source by an air gap of between about 1.0 mm and about 1.5 mm.

Preferably, the wrapper is radially spaced from at least about 50% of the front portion of the combustible heat source by the air gap. The wrapper may be radially spaced from at least about 60% of the front portion of the combustible heat source by the air gap.

Preferably, the rear portion of the combustible heat source is of substantially constant transverse cross-section. More preferably, the rear portion of the combustible heat source is of substantially constant circular transverse cross-section.

Preferably, the front portion of the combustible heat source is of substantially constant transverse cross-section.

In certain embodiments all of the front portion of the combustible heat source is of reduced diameter compared to the rear portion of the combustible heat source so that the wrapper is radially spaced from all of the front portion of the combustible heat source by the air gap. In certain preferred embodiments, the front portion and the rear portion of the combustible heat source are of substantially constant circular transverse cross-section and the combustible heat source is of substantially T-shaped longitudinal cross-section.

In other embodiments, only part of the front portion of the combustible heat source is of reduced diameter compared to the rear portion of the combustible heat source so that the wrapper is radially spaced from only part of the front portion of the combustible heat source by the air gap. In certain embodiments, the front portion of the combustible heat source comprises a plurality of circumferentially spaced-apart longitudinal grooves of reduced diameter compared to the rear portion of the combustible heat source. In certain preferred embodiments, the front portion of the combustible heat source is of substantially constant star-shaped or cog-shaped transverse cross-section and the rear portion of the combustible heat source is of substantially constant circular transverse cross-section.

Preferably, the combustible heat source has a length of between about 7 mm and about 17 mm, more preferably of between about 7 mm and about 15 mm, most preferably of between about 7 mm and about 13 mm.

Preferably, the length of the front portion of the combustible heat source is at least 5 mm.

Preferably, the length of the front portion of the combustible heat source is between about 5 mm and about 12 mm.

Preferably, the length of the rear portion of the combustible heat source is at least 3 mm.

Preferably, the length of the rear portion of the combustible heat source is between about 3 mm and about 6 mm.

Preferably, the rear portion of the combustible heat source has a diameter of between about 5 mm and about 9 mm, more preferably of between about 7 mm and about 8 mm.

Preferably, the rear portion of the combustible heat source is of substantially the same diameter as the aerosol-forming substrate.

The wrapper may be an outer wrapper. As used herein, the term 'outer wrapper' is used to describe a wrapper that is visible on the exterior of the smoking article.

Alternatively, the wrapper may be an inner wrapper. As used herein, the term 'inner wrapper' is used to describe a wrapper that is not visible or only partly visible on the exterior of the smoking article. In such embodiments, the smoking article further comprises one or more additional layers of material overlying all or part of the wrapper. For example, the smoking article may comprise an additional wrapper circumscribing all or part of the wrapper.

To facilitate supplying oxygen to the front portion of the combustible heat source, one or more air inlets are preferably provided in the wrapper and, where present, any additional layers of material overlying the wrapper, around the front portion of the combustible heat source.

Preferably, the physical integrity of the wrapper is maintained at temperatures achieved by the combustible heat source during ignition and combustion.

The wrapper may comprise heat-conductive material. The wrapper may comprise any suitable heat-conductive material or combination of materials with an appropriate thermal conductivity.

In such embodiments, the wrapper preferably comprises one or more heat-conductive materials having a bulk thermal conductivity of between about 10 W per meter Kelvin (W/(m·K)) and about 500 W per meter Kelvin (W/(m·K)), more preferably between about 15 W per meter Kelvin (W/(m·K)) and about 400 W per meter Kelvin (W/(m·K)), at 23° C. and a relative humidity of 50% as measured using the modified transient plane source (MTPS) method. Suitable heat-conductive materials include, but are not limited to: metal foils such as, for example, aluminium foil, steel foil, iron foil and copper foil; and metal alloy foils.

Alternatively or in addition, the wrapper may comprise heat-insulative material. The wrapper may comprise any suitable heat-insulative material or combination of materials. Suitable heat-insulative materials include, but are not limited to: paper.

The wrapper may be formed of a single layer of heat-conductive material or a single layer of heat insulative material.

Alternatively, the wrapper may be formed of a multilayer or laminate material comprising one or more layers of heat-conductive material and one or more layers of heat insulative material. In such embodiments, the one or more layers of heat-conductive material may comprise any of the heat-conductive materials listed above.

In certain preferred embodiments, the wrapper may be formed of a laminate material comprising a radially inner layer of heat-insulative material facing the rear portion of the combustible heat and a radially outer layer of heat-conductive material.

In such embodiments, the inclusion of a wrapper comprising a combination of a radially inner layer of heat-insulative material and a radially outer layer of heat-conductive material advantageously conducts heat from the combustible heat source to the aerosol-forming substrate, limits radiative heat loss from the combustible heat source and insulates the combustible heat source.

In certain embodiments, the wrapper may be in direct contact with the rear portion of the combustible heat source. As used herein, the term 'direct contact' is used to mean contact between two components without any intermediate material, such that the surfaces of the components are touching each other.

In other embodiments, the wrapper may be in indirect contact with the rear portion of the combustible heat source. In such embodiments, one or more layers of material are provided between the wrapper and the rear portion of the combustible heat source.

Smoking articles according to the invention may comprise a first heat-conducting element between the rear portion of the combustible heat source and the wrapper. In such embodiments, the first-heat conducting element underlies part of the wrapper.

The first heat-conducting element may be around all or part of the rear portion of the combustible heat source. Preferably, the first heat-conducting element is around all or part the rear portion of the combustible heat source and at least a front portion of the aerosol-forming substrate. The first heat-conducting element is preferably combustion resistant. In certain embodiments, the first heat conducting element is oxygen restricting. In other words, the first heat-conducting element inhibits or resists the passage of oxygen through the first heat-conducting element to the combustible heat source.

In certain embodiments, the first heat-conducting element may provide a substantially airtight connection between the combustible heat source and the aerosol-forming substrate. This may advantageously prevent or inhibit combustion gases from the combustible heat source being readily drawn into the aerosol-forming substrate through its periphery. Such a connection may also advantageously minimise or substantially avoid forced convective heat transfer from the combustible heat source to the aerosol-forming substrate by air drawn along the peripheries of the combustible heat source and the aerosol-forming substrate.

In certain embodiments, the first heat-conducting element may be around and in direct contact with all or part of the rear portion of the combustible heat source and at least a front portion of the aerosol-forming substrate. In such embodiments, all or part of the rear portion of the combustible heat source is circumscribed by and is in direct contact with the first heat-conducting element and at least a front portion of the aerosol-forming substrate is circumscribed by and is in direct contact with the first heat-conducting element. In such embodiments, the first heat-conducting element provides a thermal link between the combustible heat source and aerosol-forming substrate of smoking articles according to the invention.

In certain embodiments, the entire length of the aerosol-forming substrate may be circumscribed by the first heat-conducting element.

In other embodiments, the first heat-conducting element may circumscribe only a front portion of the aerosol-forming substrate. In such embodiments, the aerosol-forming substrate extends downstream beyond the first heat-conducting element.

In embodiments in which the first heat-conducting element circumscribes only a front portion of the aerosol-forming substrate, the aerosol-forming substrate preferably extends at least about 3 mm downstream beyond the first heat-conducting element. More preferably, the aerosol-forming substrate extends between about 3 mm and about 10 mm downstream beyond the first heat-conducting element. However, the aerosol-forming substrate may extend less than 3 mm downstream beyond the first heat-conducting element.

Preferably, the front portion of the aerosol-forming substrate circumscribed by the first heat-conducting element is between about 1 mm and about 10 mm in length, more preferably between about 2 mm and about 8 mm in length, most preferably between about 2 mm and about 6 mm in length.

The first heat-conducting element comprises heat-conductive material. The first heat-conducting element may comprise any suitable heat-conductive material or combination of materials with an appropriate thermal conductivity.

Preferably, the first heat-conducting element comprises one or more heat-conductive materials having a bulk thermal conductivity of between about 10 W per meter Kelvin (W/(m·K)) and about 500 W per meter Kelvin (W/(m·K)), more preferably between about 15 W per meter Kelvin (W/(m·K)) and about 400 W per meter Kelvin (W/(m·K)), at 23° C. and a relative humidity of 50% as measured using the modified transient plane source (MTPS) method. Suitable heat-conductive materials include, but are not limited to: metal foil wrappers such as, for example, aluminium foil wrappers, steel wrappers, iron foil wrappers and copper foil wrappers; and metal alloy foil wrappers.

The first heat-conducting element may be formed of a single layer of heat-conductive material. Alternatively, the first heat-conducting element may be formed of a multilayer or laminate material comprising at least one layer of heat-conductive material in combination with one or more other heat-conducting layers or non-heat-conducting layers. In such embodiments, the at least one layer of heat-conductive material may comprise any of the heat-conductive materials listed above.

In certain embodiments, the first heat-conducting element may be formed of a laminate material comprising at least one layer of heat-conductive material and at least one layer of heat-insulative material. In such embodiments, the radially inner layer of the first heat-conducting element facing the rear portion of the combustible heat may be a layer of heat-conductive material and the radially outer layer of the first heat-conducting element may be a layer of heat-insulative material.

Preferably the thickness of the first heat-conducting element is between about 5 microns and about 50 microns, more preferably between about 10 microns and about 30 microns and most preferably about 20 microns. In certain particularly preferred embodiments, the first heat-conducting element comprises aluminium foil having a thickness of about 20 microns.

Alternatively or in addition to a first heat-conducting element underlying part of the wrapper, smoking articles according to the invention may comprise a second heat-conducting element overlying all or part of the wrapper.

Where smoking articles according to the invention comprise a first heat-conducting element and a second heat-conducting element, the second heat-conducting element is preferably around at least a portion of the first heat-conducting element. That is the second heat-conducting element preferably overlies at least a portion of the first heat-conducting element. In such embodiments, at least part of the second heat-conducting element is radially separated from the first heat-conducting element by the wrapper.

As used herein, the term 'radially separated' is used to indicate that at least part of the second heat-conducting element is spaced apart from the first heat-conducting element in a radial direction by the wrapper, such that there is no direct contact between at least part of the second heat-conducting element and the first heat-conducting element.

Preferably, all or substantially all of the second heat-conducting element is radially separated from the first heat-conducting element by the wrapper, such that there is substantially no direct contact between the first heat-conducting element and the second heat-conducting element. This advantageously limits or inhibits conductive heat transfer from the first heat-conducting element to the second heat-conducting element. This advantageously results in the second heat-conducting element retaining a lower temperature than the first heat-conducting element.

In such embodiments, the second heat-conducting element advantageously reduces heat losses from the first heat-conducting element. In use, the second heat-conducting element will increase in temperature during smoking of the smoking article, as heat is generated by the combustible heat source. The increased temperature of the second heat-conducting element reduces the temperature differential between the first heat-conducting element, the wrapper and any additional intervening layers of material, such that heat losses from the first heat-conducting element can be reduced. By reducing heat losses from the first heat-conducting element, the second heat-conducting element advantageously helps to better maintain the temperature of the first heat-conducting element within a desired temperature range.

The second heat-conducting element comprises heat-conductive material. The second heat-conducting element may comprise any suitable heat-conductive material or combination of materials with an appropriate thermal conductivity.

Preferably, the second heat-conducting element comprises one or more heat-conductive materials having a bulk thermal conductivity of between about 10 W per meter Kelvin (W/(m·K)) and about 500 W per meter Kelvin (W/(m·K)), more preferably between about 15 W per meter Kelvin (W/(m·K)) and about 400 W per meter Kelvin (W/(m·K)), at 23° C. and a relative humidity of 50% as measured using the modified transient plane source (MTPS) method. Suitable heat-conductive materials include, but are not limited to: metal foil wrappers such as, for example, aluminium foil wrappers, steel wrappers, iron foil wrappers and copper foil wrappers; and metal alloy foil wrappers.

Where smoking articles according to the invention comprise a first heat-conducting element and a second heat-conducting element, the first heat-conducting element and the second heat-conducting element may comprise the same or different heat-conductive material or materials.

In certain preferred embodiments, the first heat-conducting element and the second heat-conducting element comprise the same heat-conductive material. In certain preferred embodiments, the first heat-conducting element and the second heat-conducting element comprise aluminium foil.

Where smoking articles according to the invention comprise a first heat-conducting element and a second heat-conducting element, preferably the second heat-conducting element comprises one or more heat reflective materials, such as aluminium or steel. In such embodiments, in use, the second heat-conducting element advantageously reflects heat radiating from the first heat-conducting element back towards the first heat-conducting element. This further reduces heat losses from the first heat-conducting element so that the temperature of the first heat-conducting element can be better controlled and the combustible heat source can be maintained at a higher temperature.

As used herein the term 'heat reflective material' refers to a material that has a relatively high heat reflectivity and a relatively low heat emissivity such that the material reflects a greater proportion of incident radiation from its surface than it emits. Preferably, the material reflects more than 50% of incident radiation, more preferably more than 70% of incident radiation and most preferably more than 75% of incident radiation.

Where smoking articles according to the invention comprise a first heat-conducting element and a second heat-conducting element comprising a heat reflective material, preferably all or substantially all of the second heat-conducting element is radially separated from the first heat-conducting element by the wrapper in order to facilitate the reflection of heat by the second heat-conducting element towards the first heat-conducting element.

The reflectivity of the second heat-conducting element may be improved by providing the second heat-conducting element with a shiny radially inner surface, wherein the radially inner surface is the surface of the second heat-conducting element that faces the radially outer surface of the first heat-conducting element.

The second heat-conducting element may be formed of a single layer of heat-conductive material. Alternatively, the second heat-conducting element may be formed of a multilayer or laminate material comprising at least one layer of heat-conductive material in combination with one or more other heat-conducting layers or non-heat-conducting layers. In such embodiments, the at least one layer of heat-conductive material may comprise any of the heat-conductive materials listed above.

In certain embodiments, the second heat-conducting element may be formed of a laminate material comprising at least one layer of heat-conductive material and at least one layer of heat-insulative material. In such embodiments, the radially inner layer of the second heat-conducting element facing the wrapper may be a layer of heat-insulative material and the radially outer layer of the second heat-conducting element may be a layer of heat-conductive material.

Where smoking articles according to the invention comprise a first heat-conducting element and a second heat-conducting element, the thickness of the second heat-conducting element may be substantially the same as the thickness of the first heat-conducting element. Alternatively, the first heat-conducting element and the second heat-conducting element may have different thicknesses to each other.

Preferably the thickness of the second heat-conducting element is between about 5 microns and about 100 microns, more preferably between about 5 microns and about 80 microns.

Preferably the second heat-conducting element comprises one or more layers of heat-conductive material having a thickness of between about 2 microns and about 50 microns, more preferably between about 4 microns and about 30 microns.

In certain embodiments, the second heat-conducting element may comprise aluminium foil having a thickness of about 20 microns.

In certain embodiments, the second heat-conducting element may comprise a laminate material comprising an outer layer of aluminium having a thickness of between about 5 microns and about 6 microns and an inner layer of paper.

Where smoking articles according to the invention comprise a first heat-conducting element and a second heat-conducting element, the position and extent of the second heat-conducting element relative to the first heat-conducting element, the combustible heat source and the aerosol-forming substrate may be adjusted in order to control heating of the aerosol-forming substrate during smoking.

The second heat-conducting element may be positioned around one or both of the front portion and the rear portion of the combustible heat source.

Where the wrapper comprises a single layer of heat-insulative material, the second heat-conducting element is preferably positioned around the front portion and the rear portion of the combustible heat source.

Alternatively or in addition, the second heat-conducting element may be positioned around at least a portion of the aerosol-forming substrate.

In certain embodiments, the aerosol-forming substrate may abut the rear portion of the combustible heat source.

As used herein, the term 'abut' is used to describe the aerosol-forming substrate being in direct contact with the rear portion of the combustible heat source or a non-combustible substantially air impermeable barrier coating provided on a rear face of the rear portion of the combustible heat source.

In other embodiments, the aerosol-forming substrate may be spaced apart from the rear portion of the combustible heat source. That is, there may be a space or gap between the aerosol-forming substrate and the rear face of the combustible heat source.

Smoking articles according to the invention may further comprise one or more first air inlets around the periphery of the aerosol-forming substrate.

In use, cool air is drawn into the aerosol-forming substrate through the first air inlets. The air drawn into the aerosol-forming substrate through the first air inlets passes downstream through the smoking article from the aerosol-forming substrate and exits the smoking article through the proximal end thereof.

During puffing by a user, cool air drawn into the aerosol-forming substrate through the one or more first inlets may advantageously reduce the temperature of the aerosol-forming substrate of smoking articles according to the invention. This may advantageously substantially prevent or inhibit spikes in the temperature of the aerosol-forming substrate of smoking articles according to the invention during puffing by a user.

In certain preferred embodiments, the one or more first air inlets are located proximate to the downstream end of the aerosol-forming substrate.

Alternatively or in addition, where the aerosol-forming substrate is spaced apart from the rear portion of the combustible heat source, smoking articles according to the invention may further comprise one or more second air inlets between the rear portion of the combustible heat source and the aerosol-forming substrate. In use, cool air is drawn into the space between the combustible heat source and the aerosol-forming substrate through the second air inlets. The air drawn into the space between the combustible heat source and the aerosol-forming substrate through the second air inlets passes downstream through the smoking article from the space between the combustible heat source and the aerosol-forming substrate and exits the smoking article through the proximal end thereof.

During puffing by a user, cool air drawn through the one or more second inlets between the rear portion of the combustible heat source and the aerosol-forming substrate may also advantageously reduce the temperature of the aerosol-forming substrate of smoking articles according to the invention. This may advantageously substantially prevent or inhibit spikes in the temperature of the aerosol-forming substrate of smoking articles according to the invention during puffing by a user.

Alternatively or in addition, smoking articles according to the invention may further comprise one or more third air inlets downstream of the aerosol-forming substrate.

It will be appreciated that smoking articles according to the invention may comprise any combination of one or more first air inlets around the periphery of the aerosol-forming, one or more second air inlets between the rear portion of the combustible heat source and the aerosol-forming substrate and one or more third air inlets downstream of the aerosol-forming substrate.

Smoking articles according to the invention may comprise a first non-combustible substantially air impermeable barrier between the rear portion of the combustible heat source and the aerosol-forming substrate.

As used herein, the term 'non-combustible' is used to describe a barrier that is substantially non-combustible at temperatures reached by the combustible heat source during combustion and ignition thereof.

The first barrier may abut one or both of the rear portion of the combustible heat source and a front portion of the aerosol-forming substrate. Alternatively, the first barrier may be spaced apart from one or both of the rear portion of the combustible heat source and the aerosol-forming substrate.

The first barrier may be adhered or otherwise affixed to one or both of the rear portion of the combustible heat source and the aerosol-forming substrate.

In certain preferred embodiments, the first barrier comprises a non-combustible substantially air impermeable first barrier coating provided on a rear face of the rear portion of the combustible heat source. In such embodiments, preferably the first barrier comprises a first barrier coating provided on at least substantially the entire rear face of the rear portion of the combustible heat source. More preferably, the first barrier comprises a first barrier coating provided on the entire rear face of the rear portion of the combustible heat source.

As used herein, the term 'coating' is used to describe a layer of material that covers and is adhered to the combustible heat source.

The first barrier may advantageously limit the temperature to which the aerosol-forming substrate is exposed during ignition and combustion of the combustible heat source, and so help to avoid or reduce thermal degradation or combustion of the aerosol-forming substrate during use of the smoking article. This is particularly advantageous where the combustible heat source comprises one or more additives to aid ignition of the combustible heat source.

Inclusion of a non-combustible substantially air impermeable first barrier between the rear portion of the combustible heat source and the aerosol-forming substrate may also advantageously substantially prevent or inhibit migration of components of the aerosol-forming substrate of smoking articles according to the invention to the combustible heat source during storage of the smoking articles.

Alternatively or in addition, inclusion of a non-combustible substantially air impermeable first barrier between the rear portion of the combustible heat source and the aerosol-forming substrate may advantageously substantially prevent or inhibit migration of components of the aerosol-forming substrate of smoking articles according to the invention to the combustible heat source during use of the smoking articles.

Inclusion of a non-combustible substantially air impermeable first barrier between the rear portion of the combustible heat source and the aerosol-forming substrate may be particularly advantageous where the aerosol-forming substrate comprises at least one aerosol-former. In such embodiments, inclusion of a non-combustible substantially air impermeable first barrier between the rear portion of the combustible heat source and the aerosol-forming substrate may advantageously prevent or inhibit migration of the at least one aerosol-former from the aerosol-forming substrate to the combustible heat source during storage and use of the smoking article. Decomposition of the at least one aerosol-former during use of the smoking articles may thus be advantageously substantially avoided or reduced.

Depending upon the desired characteristics and performance of the smoking article, the first barrier may have a low thermal conductivity or a high thermal conductivity. In certain embodiments, the first barrier may be formed from material having a bulk thermal conductivity of between about 0.1 W per meter Kelvin (W/(m·K)) and about 200 W per meter Kelvin (W/(m·K)), at 23° C. and a relative humidity of 50% as measured using the modified transient plane source (MTPS) method.

The thickness of the first barrier may be appropriately adjusted to achieve good smoking performance. In certain embodiments, the first barrier may have a thickness of between about 10 microns and about 500 microns.

The first barrier may be formed from one or more suitable materials that are substantially thermally stable and non-combustible at temperatures achieved by the combustible heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the first barrier may be formed include clays and glasses. More preferred materials from which the barrier may be formed include copper, aluminium, stainless steel, alloys, alumina ($Al_2O_3$), resins, and mineral glues.

In certain preferred embodiments, the first barrier comprises a clay coating comprising a 50/50 mixture of bentonite and kaolinite provided on the rear face of the rear portion of the combustible heat source. In other preferred embodiments, the first barrier comprises a glass coating, more preferably a sintered glass coating, provided on the rear face of the rear portion of the combustible heat source.

In certain particularly preferred embodiments, the first barrier comprises an aluminium coating provided on the rear face of the rear portion of the combustible heat source.

Preferably, the barrier has a thickness of at least about 10 microns.

Due to the slight permeability of clays to air, in embodiments where the first barrier comprises a clay coating provided on the rear face of the rear portion of the combustible heat source, the clay coating more preferably has a thickness of at least about 50 microns, and most preferably of between about 50 microns and about 350 microns.

In embodiments where the first barrier is formed from one or more materials that are more impervious to air, such as aluminium, the first barrier may be thinner, and generally will preferably have a thickness of less than about 100 microns, and more preferably of about 20 microns.

In embodiments where the first barrier comprises a glass coating provided on the rear face of the rear portion of the combustible heat source, the glass coating preferably has a thickness of less than about 200 microns.

The thickness of the first barrier may be measured using a microscope, a scanning electron microscope (SEM) or any other suitable measurement methods known in the art.

Where the first barrier comprises a first barrier coating provided on the rear face of the rear portion of the combustible heat source, the first barrier coating may be applied to cover and adhere to the rear face of the rear portion of the combustible heat source by any suitable methods known in the art including, but not limited to, spray-coating, vapour deposition, dipping, material transfer (for example, brushing or gluing), electrostatic deposition or any combination thereof.

For example, the first barrier coating may be made by pre-forming a barrier in the approximate size and shape of the rear face of the rear portion of the combustible heat source, and applying it to the rear face of the rear portion of the combustible heat source to cover and adhere to at least substantially the entire rear face of the rear portion of the combustible heat source. Alternatively, the first barrier coating may be cut or otherwise machined after it is applied to the rear face of the rear portion of the combustible heat source. In one preferred embodiment, aluminium foil is applied to the rear face of the rear portion of the combustible heat source by gluing or pressing it to the combustible heat source, and is cut or otherwise machined so that the aluminium foil covers and adheres to at least substantially the entire rear face of the rear portion of the combustible heat source, preferably to the entire rear face of the combustible heat source.

In another preferred embodiment, the first barrier coating is formed by applying a solution or suspension of one or more suitable coating materials to the rear face of the rear portion of the combustible heat source. For example, the first barrier coating may be applied to the rear face of the rear portion of the combustible heat source by dipping the rear face of the rear portion of the combustible heat source in a solution or suspension of one or more suitable coating materials or by brushing or spray-coating a solution or suspension or electrostatically depositing a powder or powder mixture of one or more suitable coating materials onto the rear face of the rear portion of the combustible heat source. Where the first barrier coating is applied to the rear face of the rear portion of the combustible heat source by electrostatically depositing a powder or powder mixture of one or more suitable coating materials onto the rear face of the rear portion of the combustible heat source, the rear face of the rear portion of the combustible heat source is preferably pre-treated with water glass before electrostatic deposition. Preferably, the first barrier coating is applied by spray-coating.

The first barrier coating may be formed through a single application of a solution or suspension of one or more suitable coating materials to the rear face of the rear portion of the combustible heat source. Alternatively, the first barrier coating may be formed through multiple applications of a solution or suspension of one or more suitable coating materials to the rear face of the rear portion of the combustible heat source. For example, the first barrier coating may be formed through one, two, three, four, five, six, seven or eight successive applications of a solution or suspension of one or more suitable coating materials to the rear face of the rear portion of the combustible heat source.

Preferably, the first barrier coating is formed through between one and ten applications of a solution or suspension of one or more suitable coating materials to the rear face of the rear portion of the combustible heat source.

After application of the solution or suspension of one or more coating materials to the rear face of the rear portion thereof, the combustible heat source may be dried to form the first barrier coating.

Where the first barrier coating is formed through multiple applications of a solution or suspension of one or more suitable coating materials to the rear face of the rear portion thereof, the combustible heat source may need to be dried between successive applications of the solution or suspension.

Alternatively or in addition to drying, after application of a solution or suspension of one or more coating materials to the rear face of the rear portion of the combustible heat source, the coating material on the combustible heat source may be sintered in order to form the first barrier coating. Sintering of the first barrier coating is particularly preferred where the first barrier coating is a glass or ceramic coating. Preferably, the first barrier coating is sintered at a temperature of between about 500° C. and about 900° C., and more preferably at about 700° C.

Smoking articles according to the invention may comprise a non-blind combustible heat source. As used herein, the term 'non-blind' is used to describe a combustible heat source including at least one airflow channel extending from a front face of the front portion of the combustible heat source to a rear face of the rear portion of the combustible heat source.

As used herein, the term 'airflow channel' is used to describe a channel extending along the length of a combustible heat source through which air may be drawn downstream for inhalation by a user.

In smoking articles according to the invention comprising a non-blind combustible heat source heating of the aerosol-forming substrate occurs by conduction and forced convection.

The one or more airflow channels may comprise one or more enclosed airflow channels.

As used herein, the term 'enclosed' is used to describe airflow channels that extend through the interior of the non-blind combustible heat source and are surrounded by the non-blind combustible heat source.

Alternatively or in addition, the one or more airflow channels may comprise one or more non-enclosed airflow channels. For example, the one or more airflow channels may comprise one or more grooves or other non-enclosed airflow channels that extend along the exterior of the rear portion of the non-blind combustible heat source.

The one or more airflow channels may comprise one or more enclosed airflow channels or one or more non-enclosed airflow channels or a combination thereof.

In certain embodiments, smoking articles according to the invention comprise one, two or three airflow channels extending from the front face of the front portion of the non-blind combustible heat source to the rear face of the rear portion of the non-blind combustible heat source.

In certain preferred embodiments, smoking articles according to the invention comprise a single airflow channel extending from the front face of the front portion of the non-blind combustible heat source to the rear face of the rear portion of the non-blind combustible heat source.

In certain particularly preferred embodiments, smoking articles according to the invention comprise comprises a single substantially central or axial airflow channel extending from the front face of the front portion of the non-blind combustible heat source to the rear face of the rear portion of the non-blind combustible heat source.

In such embodiments, the diameter of the single airflow channel is preferably between about 1.5 mm and about 3 mm.

It will be appreciated that in addition to one or more airflow channels through which air may be drawn for inhalation by a user, smoking articles according to the invention may comprise non-blind combustible heat sources comprising one or more closed or blocked passageways through which air may not be drawn for inhalation by a user.

For example, smoking articles according to the invention may comprise non-blind combustible heat sources comprising one or more airflow channels extending from the front face of the front portion of the non-blind combustible heat source to the rear face of the rear portion of the non-blind combustible heat source and one or more closed passageways that extend from the front face of the front portion of the non-blind combustible heat source only part way along the length combustible heat source.

The inclusion of one or more closed air passageways increases the surface area of the non-blind combustible heat source that is exposed to oxygen from the air and may advantageously facilitate ignition and sustained combustion of the non-blind combustible heat source.

Where smoking articles according to the invention comprise a non-blind combustible heat source and a non-combustible, substantially air impermeable first barrier between the rear portion of the combustible heat source and the aerosol-forming substrate, the first barrier should be configured to allow air entering the smoking article through the one or more airflow channels to be drawn downstream through the smoking article.

Alternatively or in addition to a non-combustible, substantially air impermeable first barrier between the rear portion of the combustible heat source and the aerosol-forming substrate, smoking articles according to the invention comprising a non-blind combustible heat source may comprise a non-combustible substantially air impermeable second barrier between the non-blind combustible heat source and the one or more airflow channels.

The second barrier between the non-blind combustible heat source and the one or more airflow channels may advantageously substantially prevent or inhibit combustion and decomposition products formed during ignition and combustion of the non-blind combustible heat source from entering air drawn into smoking articles according to the invention through the one or more airflow channels as the drawn air passes through the one or more airflow channels. This is particularly advantageous where the non-blind combustible heat source comprises one or more additives to aid ignition or combustion of the non-blind combustible heat source.

Inclusion of a non-combustible substantially air impermeable second barrier between the non-blind combustible heat source and the one or more airflow channels may also advantageously substantially prevent or inhibit activation of combustion of the non-blind combustible heat source during puffing by a user. This may substantially prevent or inhibit spikes in the temperature of the aerosol-forming substrate during puffing by a user.

By preventing or inhibiting activation of combustion of the non-blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The second barrier between the non-blind combustible heat source and the one or more airflow channels may be adhered or otherwise affixed to the non-blind combustible heat source.

In certain preferred embodiments, the second barrier comprises a non-combustible substantially air impermeable second barrier coating provided on an inner surface of the one or more airflow channels. In such embodiments, preferably the second barrier comprises a second barrier coating provided on at least substantially the entire inner surface of the one or more airflow channels. More preferably, the second barrier comprises a second barrier coating provided on the entire inner surface of the one or more airflow channels.

In other embodiments, the second barrier coating may be provided by insertion of a liner into the one or more airflow channels. For example, where the one or more airflow channels comprise one or more enclosed airflow channels that extend through the interior of the non-blind combustible heat source, a non-combustible substantially air impermeable hollow tube may be inserted into each of the one or more airflow channels.

Depending upon the desired characteristics and performance of the smoking article, the second barrier may have a low thermal conductivity or a high thermal conductivity. Preferably, the second barrier has a low thermal conductivity.

The thickness of the second barrier may be appropriately adjusted to achieve good smoking performance. In certain embodiments, the second barrier may have a thickness of between about 30 microns and about 200 microns. In a preferred embodiment, the second barrier has a thickness of between about 30 microns and about 100 microns.

The second barrier may be formed from one or more suitable materials that are substantially thermally stable and non-combustible at temperatures achieved by the non-blind combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the second barrier may be formed include clays, glasses, aluminium, iron oxide and combinations thereof. If desired, catalytic ingredients, such as ingredients that promote the oxidation of carbon monoxide to carbon dioxide, may be incorporated in the second barrier. Suitable catalytic ingredients include, but are not limited to, for example, platinum, palladium, transition metals and their oxides.

Where the second barrier comprises a second barrier coating provided on an inner surface of the one or more airflow channels, the second barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the barrier coating. In certain preferred embodiments, the second barrier coating is applied to the inner surface of the one or more airflow channels by the process described in WO-A2-2009/074870 as the combustible heat source is extruded.

Alternatively, smoking articles according to the invention may comprise a blind combustible heat source. As used herein, the term 'blind' is used to describe a combustible heat source that does not include any airflow channels extending from the front face to the rear face of the combustible heat source.

In use, the air drawn through smoking articles according to the invention comprising a blind combustible heat source for inhalation by a user does not pass through any airflow channels along the blind combustible heat source. The lack of any airflow channels through the blind combustible heat source advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The inclusion of a blind combustible heat source may also advantageously substantially prevent or inhibit combustion and decomposition products and other materials formed during ignition and combustion of the blind combustible heat source from entering air drawn through smoking articles according to the invention during use thereof. This is particularly advantageous where the blind combustible heat source comprises one or more additives to aid ignition or combustion of the blind combustible heat source.

Smoking articles according to the invention comprising a blind combustible heat source comprise one or more air inlets downstream of the rear portion of the combustible heat source. As described above, smoking articles according to the invention comprising a blind combustible heat source may comprise one or more of: one or more first air inlets around the periphery of the aerosol-forming; one or more second air inlets between the rear portion of the combustible heat source and the aerosol-forming substrate; and one or more third air inlets downstream of the aerosol-forming substrate.

In smoking articles according to the invention comprising a blind combustible heat source, heat transfer from the blind combustible heat source to the aerosol-forming substrate occurs primarily by conduction and heating of the aerosol-forming substrate by forced convection is minimised or reduced. This may advantageously helps to minimise or reduce the impact of a user's puffing regime on the composition of the mainstream aerosol of smoking articles according to the invention.

In smoking articles according to the invention comprising a blind combustible heat source, it is particularly important to optimise the conductive heat transfer between the combustible heat source and the aerosol-forming substrate. In such embodiments, the inclusion of one or more of: a wrapper comprising a layer of thermally conductive material; a first heat-conducting element; and a second heat-conducting element is particularly preferred. This advantageously helps to ensure sufficiently high conductive heat transfer from the blind combustible heat source to the aerosol-forming substrate to provide an acceptable aerosol.

It will be appreciated that smoking articles according to the invention may comprise blind combustible heat sources comprising one or more closed or blocked passageways through which air may not be drawn for inhalation by a user.

For example, smoking articles according to the invention may comprise blind combustible heat sources comprising one or more closed passageways that extend from the front face at the upstream end of the blind combustible heat source only part way along the length of the blind combustible heat source.

The inclusion of one or more closed air passageways increases the surface area of the blind combustible heat source that is exposed to oxygen from the air and may advantageously facilitate ignition and sustained combustion of the blind combustible heat source.

Preferably, the combustible heat source is a carbonaceous heat source. As used herein, the term 'carbonaceous' is used to describe a combustible heat source comprising carbon. Preferably, combustible carbonaceous heat sources for use in smoking articles according to the invention have a carbon content of at least about 35 percent, more preferably of at least about 40 percent, most preferably of at least about 45 percent by dry weight of the combustible heat source.

In some embodiments, combustible heat sources according to the invention are combustible carbon-based heat sources. As used herein, the term 'carbon-based heat source' is used to describe a heat source comprised primarily of carbon.

Combustible carbon-based heat sources for use in smoking articles according to the invention have a carbon content of at least about 50 percent. For example, combustible carbon-based heat sources for use in smoking articles according to the invention may have a carbon content of at least about 60 percent, or at least about 70 percent, or at least about 80 percent by dry weight of the combustible carbon-based heat source.

Smoking articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the combustible heat source is formed from a mixture of carbon powder, modified cellulose, flour and sugar.

Instead of, or in addition to one or more binders, combustible heat sources for use in smoking articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Where smoking articles according to the invention comprise a first barrier coating provided on the rear face of the combustible heat source, such additives may be incorporated in the combustible heat source prior to or after application of the first barrier coating to the rear face of the combustible heat source.

In certain preferred embodiments, the combustible heat source is a combustible carbonaceous heat source comprising carbon and at least one ignition aid. In one preferred embodiment, the combustible heat source is a combustible carbonaceous heat source comprising carbon and at least one ignition aid as described in WO-A1-2012/164077.

As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' is also used to denote an elemental metal that releases energy during ignition of the combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible heat source, such alkali metal burn salts do not release enough energy during ignition of a combustible heat source to produce an acceptable aerosol during early puffs.

For example, combustible heat sources according to the invention may comprise one or more oxidizing agents that decompose to release oxygen upon ignition of the first portion of the combustible heat sources. Combustible heat sources according to the invention may comprise organic oxidizing agents, inorganic oxidizing agents or a combination thereof.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phospinates; phosphites; and phosphanites.

While advantageously improving the ignition and combustion properties of the combustible heat source, the inclusion of ignition and combustion additives can give rise to undesirable decomposition and reaction products during use of the smoking article. For example, decomposition of nitrates included in the combustible heat source to aid ignition thereof can result in the formation of nitrogen oxides.

The inclusion of a non-combustible substantially air impermeable first barrier between the rear face of the combustible heat source and the aerosol-forming substrate may advantageously substantially prevent or inhibit such decomposition and reaction products from entering air drawn through smoking articles according to the invention.

Where smoking articles according to the invention comprise a non-blind combustible heat source, the inclusion of a non-combustible substantially air impermeable second barrier between the one or more airflow channels and the non-blind combustible heat source may advantageously substantially prevent or inhibit such decomposition and reaction products from entering air drawn into smoking articles according to the invention through the one or more airflow channels as the drawn air passes through the one or more airflow channels.

Combustible carbonaceous heat sources for use in smoking articles according to the invention may be prepared as described in prior art that is known to persons of ordinary skill in the art.

Combustible carbonaceous heat sources for use in smoking articles according to the invention, are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction or pressing. In certain preferred embodiments, the mixture is pre-formed into a desired shape by pressing or extrusion or a combination thereof.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired shape is pyrolysed preferably in a nitrogen atmosphere at a temperature of between about 700° C. and about 900° C.

In certain embodiments, at least one metal nitrate salt is incorporated in the combustible heat source by including at least one metal nitrate precursor in the mixture of one or more carbon containing materials, one or more binders and other additives. The at least one metal nitrate precursor is then subsequently converted in-situ into at least one metal nitrate salt by treating the pyrolysed pre-formed cylindrical rod or other shape with an aqueous solution of nitric acid. In one embodiment, the combustible heat source comprises at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In preferred embodiments, exposure of the combustible heat source to a conventional yellow flame lighter or other ignition means should cause the at least one metal nitrate salt to decompose and release oxygen and energy. This decomposition causes an initial boost in the temperature of the combustible heat source and also aids in the ignition of the combustible heat source. After decomposition of the at least one metal nitrate salt, the combustible heat source preferably continues to combust at a lower temperature.

The inclusion of at least one metal nitrate salt advantageously results in ignition of the combustible heat source being initiated internally, and not only at a point on the surface thereof. Preferably, the at least one metal nitrate salt is present in the combustible heat source in an amount of between about 20 percent by dry weight and about 50 percent by dry weight of the combustible heat source.

In other embodiments, the combustible heat source comprises at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably at a temperature of between about 200° C. and about 400° C., most preferably at a temperature of about 350° C.

In use, exposure of the combustible heat source to a conventional yellow flame lighter or other ignition means should cause the at least one peroxide or superoxide to decompose and release oxygen. This causes an initial boost in the temperature of the combustible heat source and also aids in the ignition of the combustible heat source. After decomposition of the at least one peroxide or superoxide, the combustible heat source preferably continues to combust at a lower temperature.

The inclusion of at least one peroxide or superoxide advantageously results in ignition of the combustible heat source being initiated internally, and not only at a point on the surface thereof.

The combustible heat source preferably has a porosity of between about 20 percent and about 80 percent, more preferably of between about 20 percent and 60 percent. Where the combustible heat source comprises at least one metal nitrate salt, this advantageously allows oxygen to diffuse into the mass of the combustible heat source at a rate sufficient to sustain combustion as the at least one metal nitrate salt decomposes and combustion proceeds. Even more preferably, the combustible heat source has a porosity of between about 50 percent and about 70 percent, more preferably of between about 50 percent and about 60 percent as measured by, for example, mercury porosimetry or helium pycnometry. The required porosity may be readily achieved during production of the combustible heat source using conventional methods and technology.

Advantageously, combustible carbonaceous heat sources for use in smoking articles according to the invention have an apparent density of between about 0.6 $g/cm^3$ and about 1 $g/cm^3$.

Preferably, the combustible heat source has a mass of between about 300 mg and about 500 mg, more preferably of between about 400 mg and about 450 mg.

Smoking articles according to the invention preferably comprise an aerosol-forming substrate comprising at least one aerosol-former and a material capable of releasing volatile compounds in response to heating. The aerosol-forming substrate may comprise other additives and ingredients including, but not limited to, humectants, flavourants, binders and mixtures thereof.

Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon.

Preferably, the material capable of emitting volatile compounds in response to heating is a charge of tobacco-based material, most preferably a charge of homogenised tobacco-based material.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

Preferably, the aerosol-forming substrate has a length of between about 5 mm and about 20 mm, more preferably of between about 8 mm and about 12 mm.

In preferred embodiments, the aerosol-forming substrate comprises a plug of tobacco-based material wrapped in a plug wrap. In particular preferred embodiments, the aerosol-forming substrate comprises a plug of homogenised tobacco-based material wrapped in a plug wrap.

Smoking articles according to the invention preferably comprise a mouthpiece downstream of the aerosol-forming substrate. The mouthpiece is located at the proximal end of the smoking article.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Smoking articles according to the invention may further comprise an airflow directing element between the aerosol-forming substrate and the mouthpiece. In such embodiments, the airflow directing element defines an airflow pathway and directs air from at least one air inlet along the airflow pathway towards the mouth end of the smoking article.

The at least one air inlet is preferably provided between a downstream end of the aerosol-forming substrate and a downstream end of the airflow directing element. The airflow pathway preferably comprises a first portion extending longitudinally from the at least one air inlet to the aerosol-forming substrate and a second portion extending longitudinally from the aerosol-forming substrate towards the mouth end of the smoking article. In use, air drawn into the smoking article through the at least one air inlet passes along the first portion of the airflow pathway to the aerosol-forming substrate and then downstream towards the mouth end of the smoking article along the second portion of the airflow pathway.

The airflow directing element may comprise an open-ended, substantially air impermeable hollow body. In such embodiments, the exterior of the open-ended, substantially air impermeable hollow body defines one of the first portion of the airflow pathway and the second portion of the airflow pathway and the interior of the open-ended, substantially air impermeable hollow body defines the other of the first portion of the airflow pathway and the second portion of the airflow pathway. Preferably, the exterior of the open-ended, substantially air impermeable hollow body defines the first portion of the airflow pathway and the interior of the open-ended, substantially air impermeable hollow body defines the second portion of the airflow pathway.

In one preferred embodiment, the open-ended, substantially air impermeable hollow body is a cylinder, preferably a right circular cylinder.

In another preferred embodiment, the open-ended, substantially air impermeable hollow body is a truncated cone, preferably a truncated right circular cone.

The open-ended, substantially air impermeable hollow body may abut the aerosol-forming substrate. Alternatively, the open-ended, substantially air impermeable hollow body may extend into the aerosol-forming substrate.

The substantially air impermeable hollow body may be formed from one or more suitable air impermeable materials that are substantially thermally stable at the temperature of the aerosol generated by the transfer of heat from the combustible heat source to the aerosol-forming substrate. Suitable materials are known in the art and include, but are not limited to, cardboard, plastic, ceramic and combinations thereof.

Smoking articles according to the invention preferably further comprise a transfer element or spacer element between the aerosol-forming substrate and the mouthpiece.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible heat source to the aerosol-forming substrate. The inclusion of a transfer element also advantageously allows the overall length of smoking articles according to the invention to be adjusted to a desired value, for example to a length similar to that of conventional cigarettes, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the smoking article, and the presence and length of other components within the smoking article.

Preferably, the transfer element comprises at least one open-ended tubular hollow body. In such embodiments, in use, the air drawn through the smoking article passes through the at least one open-ended tubular hollow body as it passes downstream through the smoking article from the aerosol-forming substrate to the proximal end thereof.

The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Alternatively or in addition, smoking articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Smoking articles according to the invention may comprise one or more aerosol modifying agents downstream of the aerosol-forming substrate. For example, one or more of the mouthpiece, transfer element and aerosol-cooling element of smoking articles according to the invention may comprise one or more aerosol modifying agents.

Suitable aerosol-modifying agents include, but are not limited to: flavourants; and chemesthetic agents.

As used herein, the term 'flavourant' is used to describe any agent that, in use, imparts one or both of a taste or aroma to an aerosol generated by the aerosol-forming substrate of the smoking article.

As used herein, the term 'chemesthetic agent' is used to describe any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Smoking articles according to the invention may comprise one or more aerosol modifying agents that are both a flavourant and a chemesthetic agent downstream of the aerosol-forming substrate. For example, one or more of the mouthpiece, transfer element and aerosol-cooling element of smoking articles according to the invention may comprise menthol or another flavourant that provides a cooling chemesthetic effect.

Smoking articles according to the invention may be assembled using known methods and machinery.

The invention will be further described, by way of example only, with reference to the accompanying drawings in which.

Figure 1:
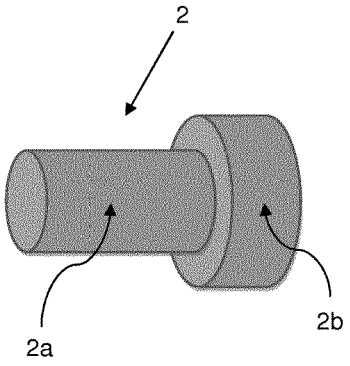
FIG. 1 shows a perspective view of a first blind combustible heat source for inclusion in a smoking article according to the invention.

The first blind combustible heat source 2 shown in FIG. 1 comprises a front portion 2*a* of substantially constant circular transverse cross-section and a rear portion 2*b* of substantially constant circular transverse cross-section. As shown in FIG. 1, the front portion 2*a* of the first blind combustible heat source 2 is of reduced diameter compared to the rear portion 2*b* of the blind combustible heat source. The first blind combustible heat source 2 shown in FIG. 1 is of substantially T-shaped longitudinal cross-section.

Figure 2:
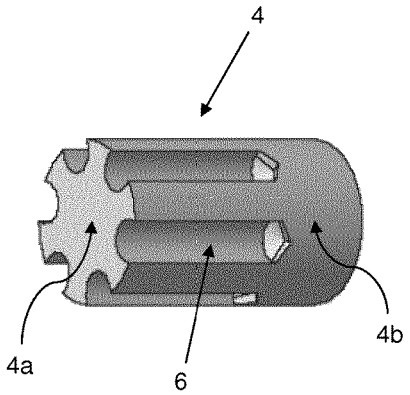
FIG. 2 shows a perspective view of a second blind combustible heat source for inclusion in a smoking article according to the invention.

The second blind combustible heat source 4 shown in FIG. 2 comprises a front portion 4*a* of generally circular transverse cross-section and a rear portion 4*b* of substantially constant circular transverse cross-section. As shown in FIG. 2, six circumferentially spaced-apart longitudinal grooves 6 of reduced diameter compared to the rear portion 4*b* of the second blind combustible heat source 4 are provided about the periphery of the front portion 4*a* of the second blind combustible heat source 4. The front portion 4*a* of the second blind combustible heat source 4 shown in FIG. 2 is of substantially constant star-shaped or cog-shaped transverse cross-section.

Figure 3:
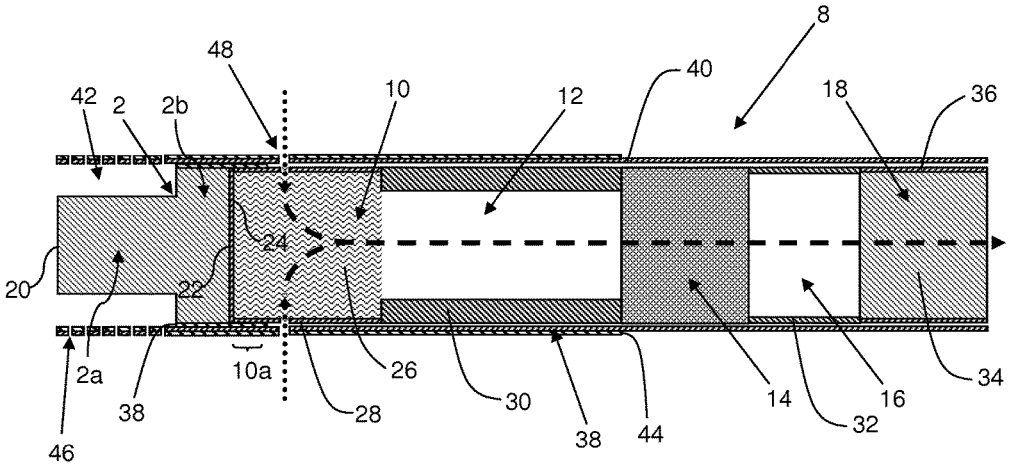
FIG. 3 shows a schematic longitudinal cross-section of a smoking article according to a first embodiment of the invention comprising the blind combustible heat source shown in FIG. 1.

The smoking article 8 according to the first embodiment of the invention shown in FIG. 3 comprises the first blind combustible heat source 2 shown in FIG. 3, an aerosol-forming substrate 10, a transfer element 12, an aerosol-cooling element 14, a spacer element 16 and a mouthpiece 18 in abutting coaxial alignment.

The first blind combustible heat source 2 has a front face 20 and an opposed rear face 22 and is located at the distal end of the smoking article 8. As shown in FIG. 3, a non-combustible substantially air impermeable first barrier 24 in the form of a disc of aluminium foil is provided between the rear face 22 of the first blind combustible heat source 2 and the aerosol-forming substrate 10. The first barrier 24 is applied to the rear face 22 of the first blind combustible heat source 2 by pressing the disc of aluminium foil onto the rear face 22 of the first blind combustible heat source 2 and abuts the rear face 22 of the first blind combustible heat source 2 and the aerosol-forming substrate 10.

The aerosol-forming substrate 10 is located immediately downstream of the first barrier 24 applied to the rear face 22 of the first blind combustible heat source 2. The aerosol-forming substrate 10 comprises a cylindrical plug of homogenised tobacco-based material 26 including an aerosol former such as, for example, glycerine, wrapped in plug wrap 28.

The transfer element 12 is located immediately downstream of the aerosol-forming substrate 10 and comprises a cylindrical open-ended hollow cellulose acetate tube 30.

The aerosol-cooling element 14 is located immediately downstream of the transfer element 12 and comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube 32.

The mouthpiece 18 is located immediately downstream of the spacer element 16. As shown in FIG. 3, the mouthpiece 18 is located at the proximal end of the smoking article 8 and comprises a cylindrical plug of suitable filtration material 34 such as, for example, cellulose acetate tow of very low filtration efficiency, wrapped in filter plug wrap 36.

As shown in FIG. 1, the smoking article 8 comprises a first heat-conducting element 38 of suitable material such as, for example, aluminium foil, around and in direct contact with the rear portion 2*b* of the first blind combustible heat source 2 and a front portion 10*a* of the aerosol-forming substrate 10. In the smoking article 8 according to the first embodiment of the invention shown in FIG. 3, the aerosol-forming substrate 10 extends downstream beyond the first heat-conducting element 38. That is, the first heat-conducting element 38 is not around and in direct contact with a rear portion of the aerosol-forming substrate 10. However, it will be appreciated that in other embodiments of the invention (not shown), the first heat-conducting element 38 may be around and in contact with the entire length of the aerosol-forming substrate 10.

As shown in FIG. 3, the front portion 2*a* and rear portion 2*b* of the first blind combustible heat source 2, the aerosol-forming substrate 10, transfer element 12, aerosol-cooling element 14, spacer element 16 and mouthpiece 18 are circumscribed by a wrapper 40 of heat-insulative material such as, for example, cigarette paper.

The wrapper 40 overlies the first heat conducting element 38 and is in indirect contact with the rear portion 2*a* of the combustible heat source 2. As shown in FIG. 3, as all of the front portion 2*b* of the first blind combustible heat source 2 is of reduced diameter compared to the rear portion 2*b* of the combustible heat source 2, the wrapper 40 is radially spaced from all of the front portion 2*a* of the combustible heat source by an air gap 42.

The smoking article may further comprise a band of tipping paper (not shown) circumscribing a downstream end portion of the wrapper 40.

The smoking article 8 also comprises a second heat-conducting element 44 of suitable material such as, for example, aluminium foil, around the front portion 2*a* and rear portion 2*b* of the first blind combustible heat source 2, the entire length of the aerosol-forming substrate 10 and the entire length of the transfer element 12. As shown in FIG. 3, the second heat-conducting element 44 overlies and is in direct contact with an upstream end portion of the wrapper 40.

A plurality of perforations 46 are provided in the wrapper 40 and second-heat conducting element around the front portion 2*a* of the combustible heat source 2.

The smoking article 8 according to the first embodiment of the invention further comprises one or more first air inlets 48 around the periphery of the aerosol-forming substrate 10. As shown in FIG. 3, a circumferential arrangement of first air inlets 48 is provided in the plug wrap 28 of the aerosol-forming substrate 10, the wrapper 40 and the second heat conducting element 44 to admit cool air (shown by dotted arrows in FIG. 3) into the aerosol-forming substrate 10.

In use, a user ignites the front portion 2*a* of the first blind combustible heat source 2 of the smoking article 8 according to the first embodiment of the invention and then draws on the mouthpiece 18. The plurality of perforations 46 provided in the wrapper 40 and second-heat conducting element around the front portion 2*a* of the first blind combustible heat source 2 ensure a sufficient supply of oxygen to the front portion 2*a* of the first blind combustible heat source 2 to maintain combustion thereof.

When a user draws on the mouthpiece 18, cool air (shown by dotted arrows in FIG. 3) is drawn into the aerosol-forming substrate 10 of the smoking article 8 through the first air inlets 48. The front portion 10*a* of the aerosol-forming substrate 10 is heated by conduction through the rear face 22 of the first blind combustible heat source 2 and the first barrier 24 and the first heat-conducting element 38.

The heating of the aerosol-forming substrate 10 by conduction releases glycerine and other volatile and semi-volatile compounds from the plug of homogenised tobacco-based material 26. The compounds released from the aerosol-forming substrate 10 form an aerosol that is entrained in the air drawn into the aerosol-forming substrate 10 of the smoking article 8 through the first air inlets 48 as it flows through the aerosol-forming substrate 10. The drawn air and entrained aerosol (shown by dashed arrows in FIG. 3) pass downstream through the interior of the cylindrical open-ended hollow cellulose acetate tube 30 of the transfer element 12, the aerosol-cooling element 14 and the spacer element 16, where they cool and condense. The cooled drawn air and entrained aerosol pass downstream through the mouthpiece 18 and are delivered to the user through the proximal end of the smoking article 8 according to the first embodiment of the invention. The non-combustible substantially air impermeable first barrier 24 on the rear face 22 of the first blind combustible heat source 2 isolates the first blind combustible heat source 2 from air drawn through the smoking article 8 such that, in use, air drawn through the smoking article 8 does not come into direct contact with the first blind combustible heat source 2.

In use, the second heat-conducting element 44 retains heat within the smoking article 8 to help maintain the temperature of the first heat-conducting element 38 during smoking. This in turn helps maintain the temperature of the aerosol-forming substrate 10 to facilitate continued and enhanced aerosol delivery. In addition, the second heat-conducting element 44 transfers heat along the aerosol-forming substrate 10, beyond the downstream end of the first heat-conducting element 38 so that heat is dispersed through a larger volume of the aerosol-forming substrate 10. This helps to provide a more consistent puff-by-puff aerosol delivery.

The air gap 42 between the wrapper 40 and the front portion 2*a* of the first blind combustible heat source 2 insulates the front portion 2*a* of the first blind combustible heat source 2 and so reduces the surface temperature of the smoking article 8 around the front portion 2*a* of the first blind combustible heat source 2.

A smoking article according to a second embodiment of the invention (not shown) is of largely identical construction to the smoking article according to the first embodiment of the invention shown in FIG. 3. However, the smoking article according to the second embodiment of the invention comprises the second blind combustible heat source shown in FIG. 2. In the smoking article according to the second embodiment of the invention, the wrapper 40 is radially spaced from the six circumferentially spaced-apart longitudinal grooves 6 provided about the periphery of the front portion 4*a* of the second blind combustible heat source 4, which are of reduced diameter compared to the rear portion 4*b* of the second blind combustible heat source 4, by an air gap.

EXAMPLE 1

Smoking articles according to the invention are assembled by hand using first blind combustible heat sources of the type shown in FIG. 1 having the dimensions shown in Table 1. For the purposes of comparison, smoking articles of the same construction and dimensions are assembled by hand using blind combustible heat sources of the same composition and substantially constant circular transverse cross-section having the dimensions shown in Table 1.

TABLE 1

| | Example 1 | Comparative Example |
|---|---|---|
| Blind Combustible Heat Source | | |
| Total length (mm) | 13 | 13 |
| Front portion length (mm) | 11 | 11 |
| Front portion diameter (mm) | 5.8 | 7.8 |
| Rear portion length (mm) | 2 | 2 |
| Rear portion diameter (mm) | 7.8 | 7.8 |
| Air Gap | | |
| Air gap between wrapper and front portion of the blind combustible heat source (mm) | 1.0 | 0 |
| Air gap between wrapper and rear portion of the blind combustible heat source (mm) | 0 | 0 |

As shown in Table 1, due to the reduced diameter of the front portion of the blind combustible heat source compared to the rear portion of the blind combustible heat source, in the smoking articles according to the invention of Example 1 the wrapper is radially spaced from all of the front portion of the blind combustible heat source by an air gap of 1.0 mm. In contrast, in the smoking articles of the comparative example there is no air gap between the wrapper and the front portion of the blind combustible heat source.

The surface temperature around the combustible heat sources of the smoking articles according to the invention of Example 1 and the smoking articles of the comparative example is tested. Ten Whatman filters are placed on top of a standard filter holder. The blind combustible heat sources of the smoking articles are lit using a yellow flame lighter. The flame is removed when lighting propagation occurs. The colour at the surface of the blind combustible heat sources changes upon ignition due to downstream movement of a deflagration front from the front end to the rear end of the blind combustible heat sources. Thirty seconds after the deflagration front has reached the rear end of the blind combustible heat sources, the smoking articles are placed horizontally on top of the ten Whatman filters. The smoking articles are left on the Whatman filters for 10 minutes. The Whatman filters are then removed from the filter holder and the first (uppermost), third, sixth and tenth (lowermost) Whatman filters analysed for the occurrence of burning and the depth of heat penetration.

The first, third, sixth and tenth filters for the smoking article of the comparative example are all marked. In contrast, the third, sixth and tenth filters for the smoking article according to the invention of Example 1 are unmarked.

EXAMPLE 2

Smoking articles according to the invention are assembled by hand using second blind combustible heat sources of the type shown in FIG. 1 having the dimensions shown in Table 2. For the purposes of comparison, smoking articles of the same construction and dimensions are assembled by hand using blind combustible heat sources of the same composition and substantially constant circular transverse cross-section having the dimensions shown in Table 2.

TABLE 2

| | Example 2 | Comparative Example |
|---|---|---|
| Blind Combustible Heat Source | | |
| Total length (mm) | 13 | 13 |
| Front portion length (mm) | 9 | 9 |
| Front portion diameter (mm) | 7.8 | 7.8 |
| Maximum depth of circumferentially spaced-apart longitudinal grooves provided about the periphery of the front portion of the blind combustible heat | 0.5 | 0 |
| Rear portion length (mm) | 4 | 4 |
| Rear portion diameter (mm) | 7.8 | 7.8 |
| Air Gap | | |
| Air gap between wrapper and circumferentially spaced-apart longitudinal grooves provided about the periphery of the front portion of the blind combustible heat source (mm) | 0.5 | 0 |
| Air gap between wrapper and rear portion of the blind combustible heat source (mm) | 0 | 0 |

As shown in Table 1, due to the reduced diameter of the plurality of circumferentially spaced-apart longitudinal grooves provided about the periphery of the front portion of the blind combustible heat source compared to the rear portion of the blind combustible heat source, in the smoking articles according to the invention of Example 2 the wrapper is radially spaced from part of the front portion of the blind combustible heat source by an air gap of 0.5 mm. In contrast, in the smoking articles of the comparative example there is no air gap between the wrapper and the front portion of the blind combustible heat source.

The surface temperature around the combustible heat sources of the smoking articles according to the invention of Example 2 and the smoking articles of the comparative example is tested. Ten Whatman filters are placed on top of a standard filter holder. The blind combustible heat sources of the smoking articles are lit using a yellow flame lighter. The flame is removed when lighting propagation occurs. The colour at the surface of the blind combustible heat sources changes upon ignition due to downstream movement of a deflagration front from the front end to the rear end of the blind combustible heat sources. Thirty seconds after the deflagration front has reached the rear end of the blind combustible heat sources, the smoking articles are placed horizontally on top of the ten Whatman filters. The smoking articles are left on the Whatman filters for 10 minutes. The Whatman filters are then removed from the filter holder and the first (uppermost), third, sixth and tenth (lowermost) Whatman filters analysed for the occurrence of burning and the depth of heat penetration.

The first, third, sixth and tenth filters for the smoking article of the comparative example are all marked. In contrast, the sixth and tenth filters for the smoking article according to the invention of Example 2 are unmarked.

The results of Examples 1 and 2 demonstrate that the inclusion of an air gap of at least about 0.5 mm between all or part of the front portion of the combustible heat source and the wrapper advantageously reduces the temperature of the surface of smoking articles according to the invention.

The embodiments and examples described above illustrate but do not limit the invention. Other embodiments of the invention may be made and it is to be understood that the specific embodiments and examples described herein are not limiting.

The invention claimed is:

1. A smoking article, comprising:

a combustible heat source having a front portion and a rear portion;

an aerosol-forming substrate downstream of the rear portion of the combustible heat source; and a wrapper circumscribing the front portion and the rear portion of the combustible heat source, wherein the wrapper is in contact with the rear portion of the combustible heat source, and wherein all or part of the front portion of the combustible heat source is of reduced diameter compared to the rear portion of the combustible heat source so that the wrapper is radially spaced from said all or part of the front portion of the combustible heat source by an air gap of at least about 0.5 mm.

2. The smoking article according to claim 1, wherein the wrapper is radially spaced from said all or part of the front portion of the combustible heat source by an air gap of between about 0.5 mm and about 1.5 mm.

3. The smoking article according to claim 1, wherein the wrapper is radially spaced from at least about 50% of the front portion of the combustible heat source by the air gap.

4. The smoking article according to claim 1, wherein all of the front portion of the combustible heat source is of said reduced diameter compared to the rear portion of the combustible heat source so that the wrapper is radially spaced from all of the front portion of the combustible heat source by the air gap.

5. The smoking article according to claim 1, wherein the front portion of the combustible heat source comprises a plurality of circumferentially spaced-apart longitudinal grooves of reduced diameter compared to the rear portion of the combustible heat source.

6. The smoking article according to claim 1, wherein the wrapper comprises one or more layers of heat-conductive material.

7. The smoking article according to claim 6, wherein the wrapper comprises one or more layers of aluminium.

8. The smoking article according to claim 1, wherein the wrapper comprises one or more layers of heat-insulative material.

9. The smoking article according to claim 8, wherein the wrapper comprises one or more layers of paper.

10. The smoking article according to claim 1, wherein the wrapper comprises a radially inner layer of heat-insulative material and a radially outer layer of heat-conductive material.

11. The smoking article according to claim 1, wherein one or more air inlets are provided in the wrapper around the front portion of the combustible heat source.

12. The smoking article according to claim 1, wherein the rear portion of the combustible heat source is of substantially the same diameter as the aerosol-forming substrate.

13. The smoking article according to claim 1, wherein the combustible heat source is a blind combustible heat source.

14. The smoking article according to claim 1, wherein one or more longitudinal airflow channels are provided through the combustible heat source.

15. The smoking article according to claim 14, further comprising a non-combustible substantially air impermeable barrier between the combustible heat source and the one or more longitudinal airflow channels.

16. The smoking article according to claim 1, further comprising a non-combustible substantially air impermeable barrier between the rear portion of the combustible heat source and the aerosol-forming substrate.

* * * * *